US011174628B1

(12) United States Patent
Nien

(10) Patent No.: US 11,174,628 B1
(45) Date of Patent: Nov. 16, 2021

(54) LIQUID DETERGENT SUPPLY FOR TOILET

(71) Applicant: Chun-Wei Nien, Taichung (TW)

(72) Inventor: Chun-Wei Nien, Taichung (TW)

( * ) Notice: Subject to any disclaimer, the term of this patent is extended or adjusted under 35 U.S.C. 154(b) by 0 days.

(21) Appl. No.: 16/932,510

(22) Filed: Jul. 17, 2020

(51) Int. Cl.
*E03D 9/03* (2006.01)
*E03D 9/02* (2006.01)

(52) U.S. Cl.
CPC ..... *E03D 9/037* (2013.01); *E03D 2009/028* (2013.01)

(58) Field of Classification Search
CPC ..... A01G 27/003; E03D 2009/028; E03D 9/037–038; F16K 31/18; F16K 7/063; F16K 7/068
See application file for complete search history.

(56) References Cited

U.S. PATENT DOCUMENTS 451,344 A * 4/1891 Taylor ..... E03D 9/038 4/227.5
1,010,562 A * 12/1911 Woodward ..... F16K 31/18 137/451
2,658,206 A * 11/1953 Martinez ..... E03D 9/037 4/227.3
3,670,751 A * 6/1972 Buswell ..... F16K 7/02 137/1
6,374,426 B1 * 4/2002 Falchieri ..... E03D 9/037 4/227.2

FOREIGN PATENT DOCUMENTS

GB 2139661 * 11/1984 ..... E03D 9/037
TW M367939 U 11/2009

* cited by examiner

*Primary Examiner* — David P Angwin
*Assistant Examiner* — Nicholas A Ros
(74) *Attorney, Agent, or Firm* — Thomas J. Nikolai; DeWitt LLP

(57) ABSTRACT

A liquid detergent supply for toilet includes a bottle, a lid and a flexible tube. The bottle has a connecting member for connecting with a water tank and an inner room with an opening for accommodating liquid detergent. The lid has an annular wall disposed in an end and a protruding portion in another end. A through channel communicated with the opening is disposed in the protruding portion. The flexible tube has an inlet end connected with the protruding portion to be in communication with the through channel and an outlet end penetrating into a floating block whose surface is level with the outlet end. The outlet end is tugged to float on water by a buoyancy of the floating block.

9 Claims, 5 Drawing Sheets

LIQUID DETERGENT SUPPLY FOR TOILET

BACKGROUND OF THE INVENTION

1. Technical Field

The present invention relates to a cleaning device for toilet and more particularly to a liquid detergent supply.

2. Description of Related Art

It is important to clean the toilet to keep good environmental sanitation. Besides manual labor, it is useful to put cleaner tablets into a water tank of the toilet to be dissolved gradually in the water and then cleans the toilet during flushing. If flushing frequency is low, however, the cleaner tablets are dissolved too much as a result of long time to stay in water. In light of this, too much high concentration of cleaning liquid will cause waste. In addition, the cleaner tablets are consumed so fast that its usage count is cut down.

A device to release liquid detergent quantitatively, such as that disclosed in TW Patent No. M367939, includes a bottle with liquid detergent inside, a buoy, a plunger and two pistons. The buoy raises by water level, and thus the plunger raises and the liquid detergent is stored between the pistons. When water level is down, the plunger is lowered to release the liquid detergent via a through hole located on the buoy.

The patented device mentioned above, however, is structurally complicated and include a large number of tiny components, which not only incur high material costs but also add to the technical difficulty of product assembly.

BRIEF SUMMARY OF THE INVENTION

The primary objective of the present invention is to provide a liquid detergent supply for toilet that uses only a small number of simple components to feature a lower material cost, a lower level of technical difficulty of product assembly and greater convenience of use.

To achieve the above objective, the present invention provides a liquid detergent supply for toilet that includes a bottle, a lid and a flexible tube. The bottle has a connecting member for connecting with a water tank and an inner room for accommodating liquid detergent. An opening communicated with the inner room is provided at a bottom of the bottle. The lid has an annular wall disposed in an end and a protruding portion in another end. The annular wall is connected with the opening. The protruding portion is provided with a through channel communicated with the opening. A diameter of the through channel is less than that of the opening. The flexible tube has an inlet end connected with the protruding portion to be in communication with the through channel and an outlet end penetrating into a floating block whose surface is level with the outlet end. The outlet end is tugged to float on water by a buoyancy of the floating block.

Preferably, the annular wall is connected with the opening through threads.

In one embodiment, the connecting member includes a hook portion for hanging the bottle on the water tank. The hook portion is provided with a shaft to be pivotally connected to a pivot portion disposed on a top surface of the bottle. The shaft extends in a direction that not passes through a center of the top surface.

In one embodiment, an annular flexible gasket with a surrounded space communicated with the inner room is provided inside the annular wall. The surrounded space is 8 to 9 mm in diameter, and the through channel is 1 mm in diameter. In addition, a ratio of a length of the protruding portion to a height of the surrounded space is 3:1.

In one embodiment, the inlet end is fitted with the protruding portion firmly.

DETAILED DESCRIPTION OF THE INVENTION

Figure 1:
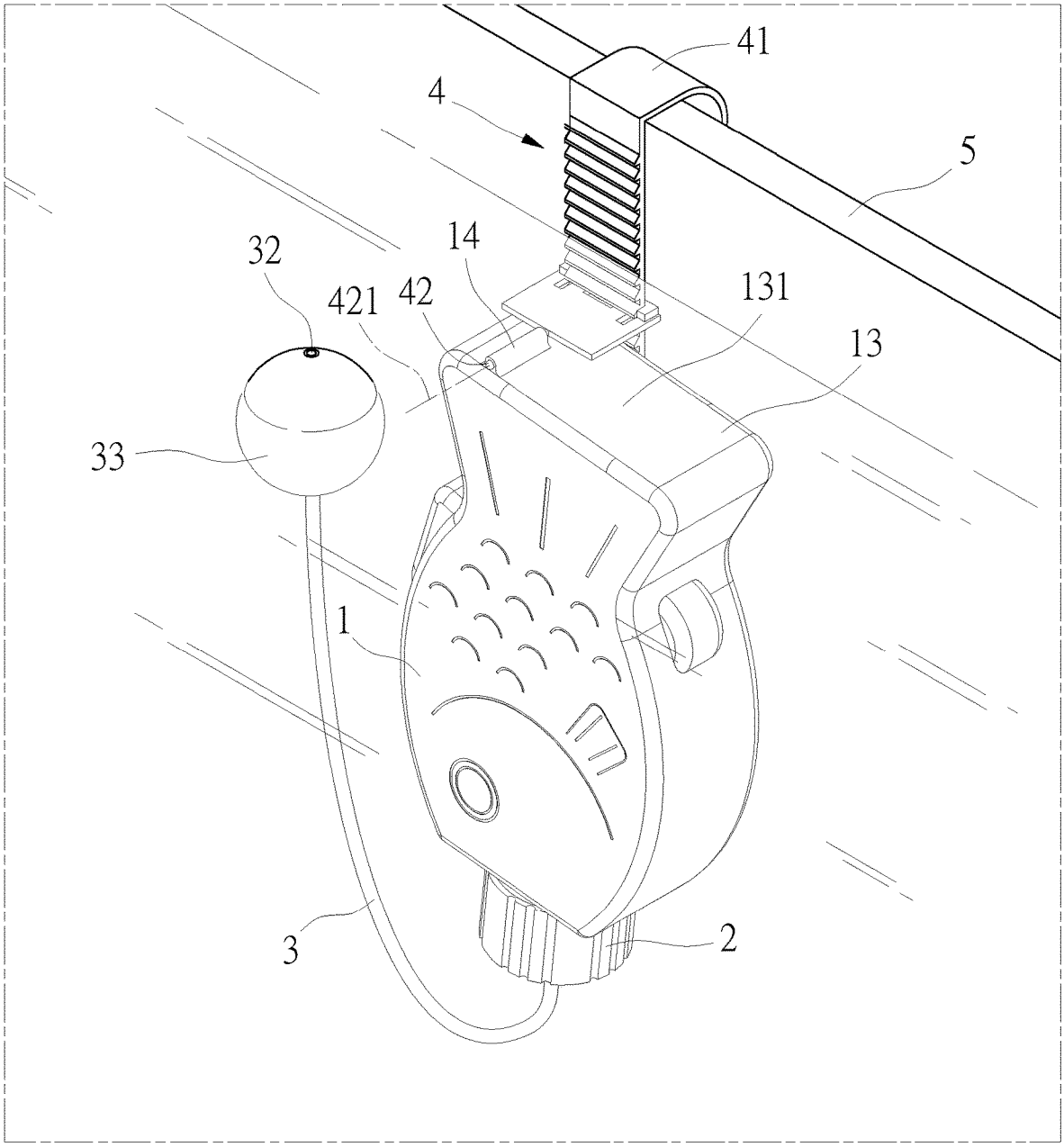
FIG. 1 is a perspective view of the present invention.
Figure 2:
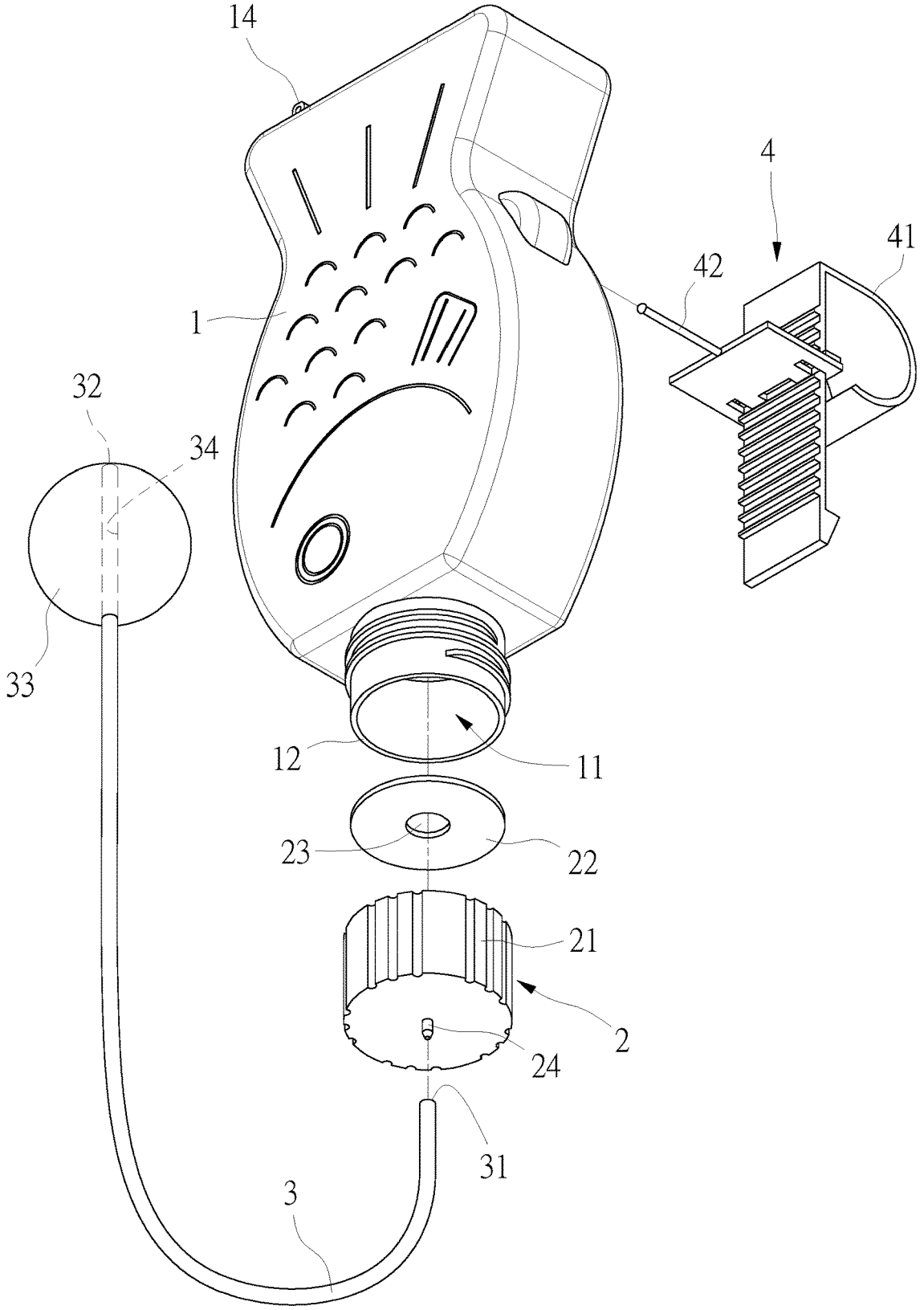
FIG. 2 is an exploded perspective view of the present invention.

Referring to FIG. 1 and FIG. 2, the liquid detergent supply for toilet includes a bottle 1, a lid 2 and a flexible tube 3. The bottle 1 includes an inner room 11 for accommodating liquid detergent, and a bottom of the bottle 1 is provided with an opening 12 that is communicated with the inner room 11. The bottle 1 is fixed on a water tank 5 with a connecting member 4. A pivot portion 14 is disposed on a top surface 13 of the bottle 1. The connecting member 4 includes a hook portion 41 for hanging the bottle on the water tank 5. The hook portion 41 is provided with a shaft 42 extending in a direction 421 to be pivotally connected to a pivot portion 14 so that the bottle 1 can swing to change position. A position where the pivot portion 14 is located is distant from a center 131 of the top surface 13, and thus the direction 421 of the shaft 42 does not pass through the center 131.

Figure 3:
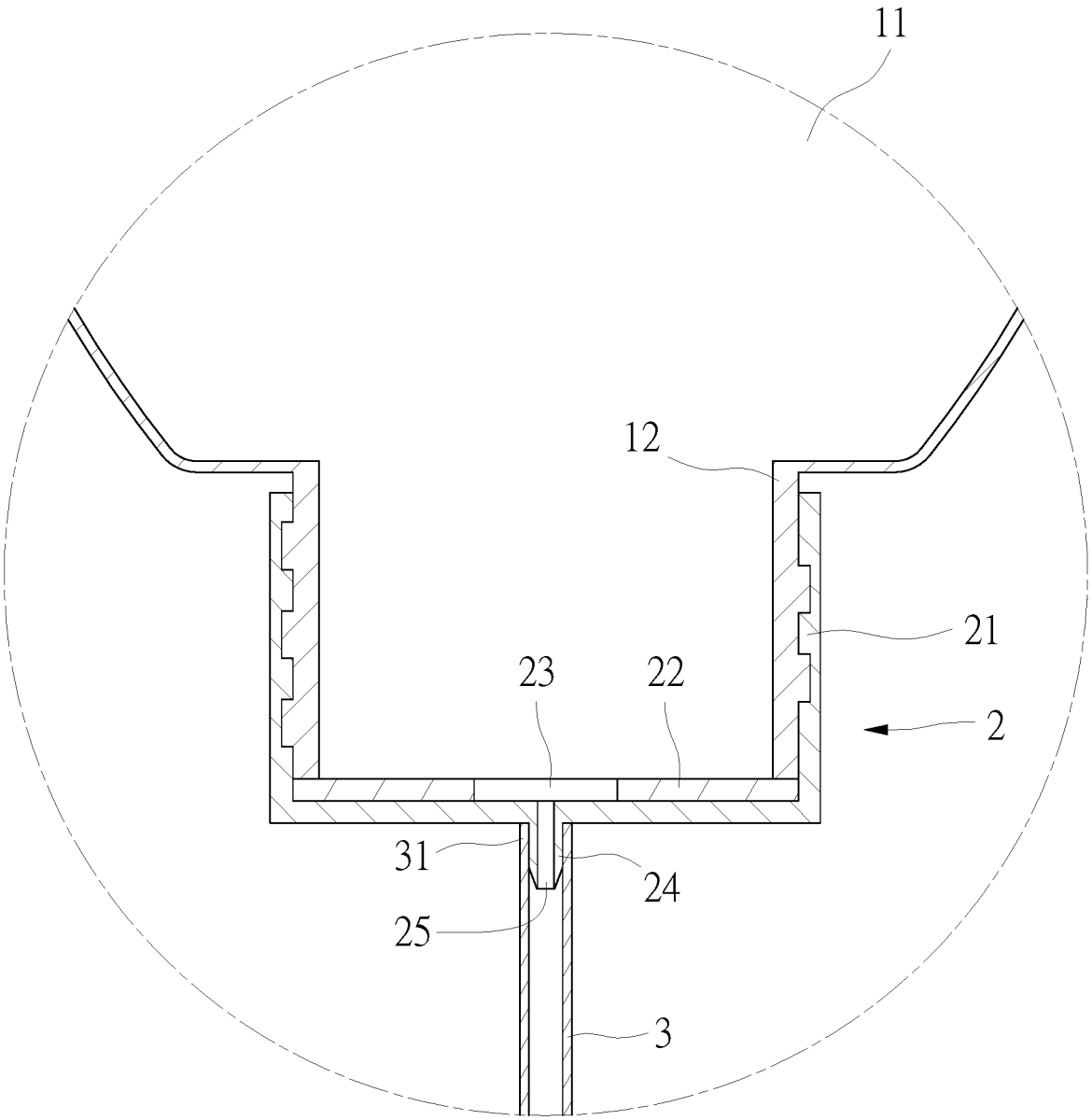
FIG. 3 is a sectional view showing the present invention in part.

One side of the lid 2 is provided with an annular wall 21 that is connected with the opening 12 through threads. A flexible gasket 22 is disposed inside the annular wall 21. The flexible gasket 22, as shown in FIG. 3, is ring-shaped to form a surrounded space 23 with a diameter of 8 to 9 mm that is communicated with the inner room 11.

Another side of the lid 2 is provided with a protruding portion 24. In this embodiment, a ratio of a length of the protruding portion 24 to a height of the surrounded space 23 is 3:1. A through channel 25 with a diameter of 1 mm is disposed in the protruding portion 24 and is communicated with the surrounded space 23.

The flexible tube 3 has an inlet end 31 and an outlet end 32. The inlet end 31 is fitted with the protruding portion 24 firmly and is communicated with the through channel 25 for liquid detergent to enter the tube 3 via the through channel 25. The outlet end 32 is connected with a ball-shaped floating block 33 capable of floating on water. The floating block 33 is provided with a hole 34 for the outlet end 32 to penetrate into. In addition, the outlet end 32 is level with the surface of the floating block 33, not protruding from the floating block 33.

Figure 4:
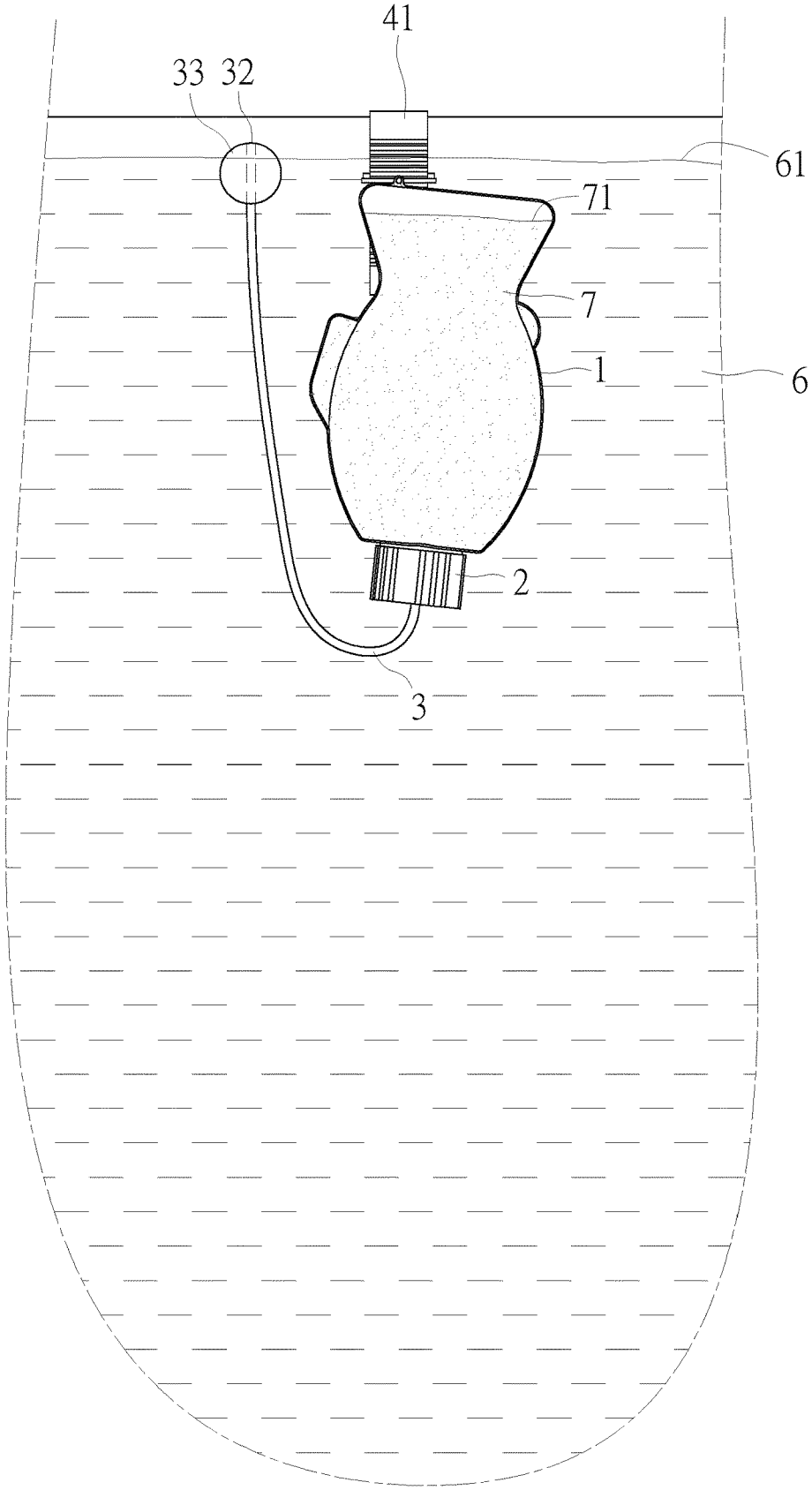
FIG. 4 and FIG. 5 show how the present invention works when in use.

In terms of use, the bottle 1 is positioned under the water with the hook portion 41 hanging on the water tank 5. When the water level is high, as shown in FIG. 4, the outlet end 32 of the tube 3 is tugged to float on water by a buoyancy of the floating block 33, and thus a position of the outlet end 32 is higher than that of liquid level 71 of detergent 7 in the bottle 1 so that detergent 7 may not be released.

Figure 5:
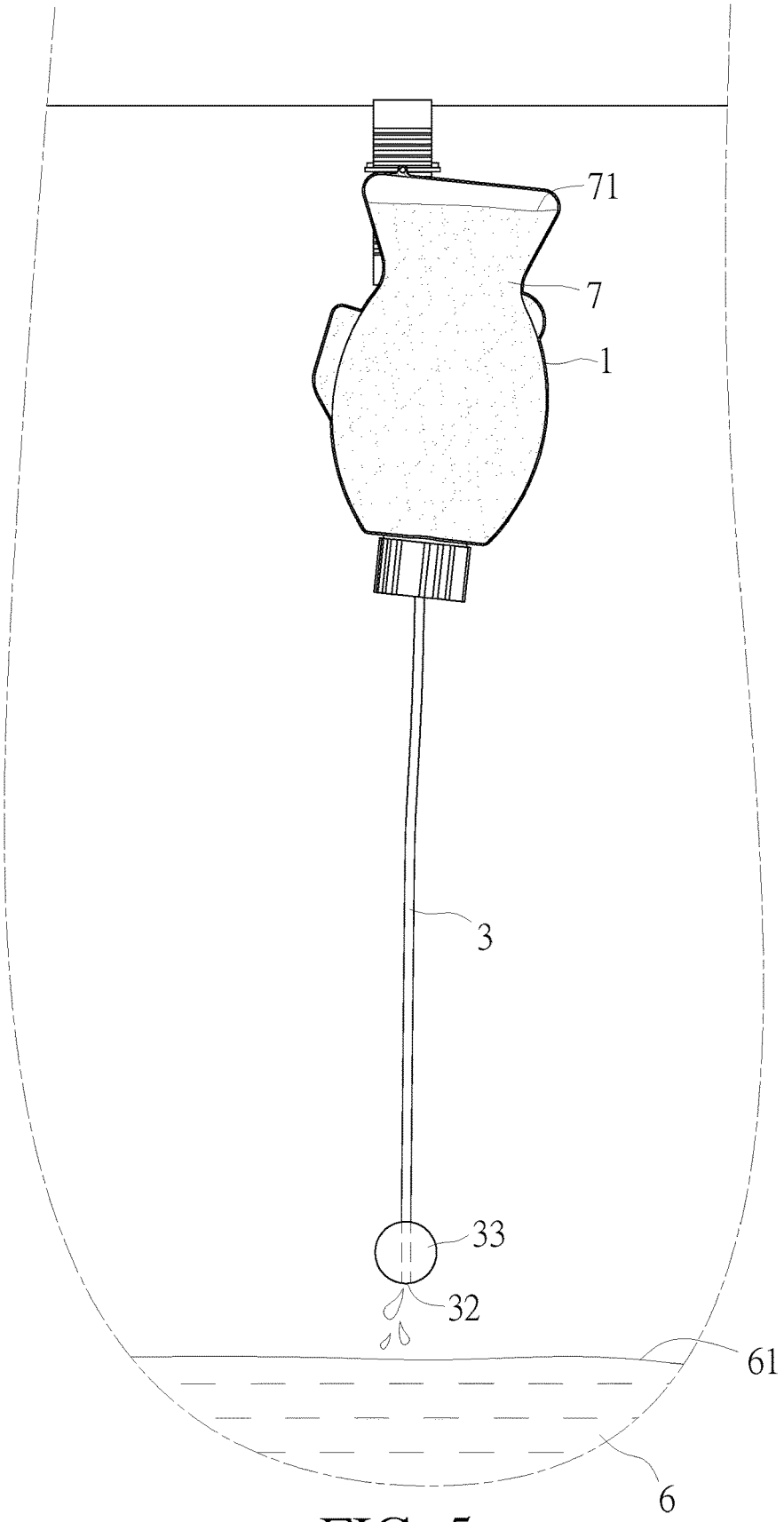

Referring to FIG. 5, water level 61 as well as the floating block 33 are lowered after flushing, and then the tube 3 is tugged to droop by the weight of the floating block 33. A position of the outlet end 32 is now lower than that of liquid level 71 of detergent 7 so that detergent 7 is released due to pressure difference.

As the water tank 5 is going to be replenished, water level 61 as well as the floating block 33 are raising. Position of the outlet end 32 is also raising due to buoyancy of the floating block 33. Detergent 7 is released from the outlet end 32 until the position of the outlet end 32 is higher than that of liquid level 71 of detergent 7. It is the same quantity of released detergent 7 during each time that the water tank 5 is replenished since the spending time to fill the water tank 5 up is unchanged. According to this, detergent concentration in the water is kept moderate with quantitatively released detergent not only to clean the toilet well but also to save consumption.

What is claimed is:

1. A liquid detergent supply assembled in a water tank of a toilet, configured to release liquid detergent during flushing, comprising:

a bottle having a connecting member for connecting with the water tank and an inner room for accommodating liquid detergent, wherein a bottom of the bottle is provided with an opening communicated with the inner room;

a lid having an annular wall disposed in an end and a protruding portion in an other end, wherein the annular wall is connected with the opening, the protruding portion is provided with a through channel communicated with the opening, wherein a diameter of the through channel is less than that of the opening; and a flexible tube having an inlet end connected with the protruding portion to be in communication with the through channel and an outlet end penetrating into a floating block whose surface is level with the outlet end, the outlet end being tugged to float on water by a buoyancy of the floating block.

2. The liquid detergent supply of claim 1, wherein the annular wall is connected with the opening through threads.

3. The liquid detergent supply of claim 1, wherein the floating block is ball-shaped.

4. The liquid detergent supply of claim 1, wherein the inlet end is fitted with the protruding portion firmly.

5. The liquid detergent supply of claim 1, wherein the connecting member includes a hook portion for hanging the bottle on the water tank, and the hook portion is provided with a shaft to be pivotally connected to a pivot portion disposed on the bottle.

6. The liquid detergent supply of claim 5, wherein the pivot portion is provided on a top surface of the bottle, and the shaft extends in a direction that not passes through a center of the top surface.

7. The liquid detergent supply of claim 1, wherein an annular flexible gasket with a surrounded space communicated with the inner room is provided inside the annular wall.

8. The liquid detergent supply of claim 7, wherein the surrounded space is 8 to 9 mm in diameter, and the through channel is 1 mm in diameter.

9. The liquid detergent supply of claim 7, wherein a ratio of a length of the protruding portion to a height of the surrounded space is 3:1.

* * * * *